US005266182A

United States Patent [19]

Muko et al.

[11] Patent Number: 5,266,182

[45] Date of Patent: Nov. 30, 1993

[54] METHOD FOR PRODUCING ZN-NI ALLOY PLATED STEEL PLATE HAVING SUPERIOR PRESS FORMABILITY

[75] Inventors: Ryoichi Muko; Kazuo Mochizuki; Hajime Kimura; Toshio Ichida, all of Chiba, Japan

[73] Assignee: Kawasaki Steel Corporation, Japan

[21] Appl. No.: 821,439

[22] Filed: Jan. 15, 1992

Related U.S. Application Data

[63] Continuation of Ser. No. 381,643, Jun. 27, 1989, abandoned.

[30] Foreign Application Priority Data

Mar. 16, 1988 [JP] Japan ..... 63-60575

[51] Int. Cl.[5] ..... C25D 3/56

[52] U.S. Cl. ..... 205/246

[58] Field of Search ..... 205/246

[56] References Cited

U.S. PATENT DOCUMENTS

| | | | |
|---|---|---|---|
| 3,791,801 | 2/1974 | Ariga et al. | 205/244 |
| 4,569,731 | 2/1986 | Matsuda et al. | 204/28 |
| 4,765,871 | 8/1988 | Hsu et al. | 205/15 |
| 4,834,845 | 5/1989 | Muko et al. | 204/28 |
| 4,839,241 | 6/1989 | Abe et al. | 205/109 |
| 4,861,442 | 8/1989 | Nishihama et al. | 205/246 |

*Primary Examiner*—John Niebling
*Assistant Examiner*—Brian M. Bolam
*Attorney, Agent, or Firm*—Bierman and Muserlian

[57] ABSTRACT

A Zn-Ni alloy plated steel plate having stable formability may be obtained by subjecting the plated surface of a Zn-Ni alloy plated steel plate having Ni contents of 10 to 17 wt. % to a dipping treatment, a spraying treatment or to an anodic treatment, using a solution containing one or both $H_2PO_4^-$ and $HPO_4^{2-}$.

3 Claims, 3 Drawing Sheets

METHOD FOR PRODUCING ZN-NI ALLOY PLATED STEEL PLATE HAVING SUPERIOR PRESS FORMABILITY

PRIOR APPLICATION

This application is a continuation of U.S. patent application Ser. No. 381,643 filed Jun. 27, 1989, now abandoned.

FIELD OF THE INVENTION

This invention relates to a method for producing a Zn-Ni alloy plated steel plate having superior press formability.

BACKGROUND OF ART

The Zn-Ni alloy plated steel sheet, strip or plate exhibits corrosion resistance about five to ten times that of the Zn-plated steel plate having the same deposited amount of the plated metal. For this reason, it is used in an increasing, amount as a steel plate for coping with the problem recently presented of early corrosion of vehicle bodies caused by road freezing preventive agents employed in winter, and is used at various portions from the front fender to a bonnet and trunk lid outer. Also the present-day trend is to use a double side plated steel plate on the outer surface of the vehicle body with the aim of improving the corrosion resistance after peel-off of the coating by the stones or pebbles striking on the outer surface, to replace the one side plated steel plate during the time of early usage of the plated steel plates which was aimed at preventing rusting at the portions where coating may be insufficient, such as the inner surface of the vehicle body.

For preparing the Zn-Ni plated steel plate, there are required properties different from those required of the one side plated plate. Among these properties is the press formability.

In view of the above described usage of the single side plated steel plate, it is a frequent occurrence that the inner side of the punch, that is, the cold rolled surface thereof, turns out to be the protruding surface at the time of press working, so that the plated surface has little effect on the press formability.

However, in the case of the double side plated steel plate, the plated surface turns out to be the protruding surface at the time of press working, and the friction of the plated surface itself presents problems. Although the press working may naturally be facilitated with the use of the highly viscous press oil at the time of press working, the customary practice is to apply the rust preventive oil of low viscosity to the plated steel plate and to perform the press working with the rust preventive oil resting on the plate surface to facilitate the degreasing and coating at the user. The plated plate is required to have satisfactory workability with the rust preventive oil applied thereto.

As the method for improving the press formability of the Zn-Ni alloy plated plate, there is known a method consisting in applying a Zn-Ni alloy plating in double layers to increase the Ni contents of the upper layer, as disclosed in the Japanese Patent Application KOKAI No.141894/1985.

This method utilizes the so-called powdering of the upper Zn-Ni plating layer to improve the press workability, the peeled-off powders are placed and heaped on the press mold surface, in case of continuous stamping of a large number of samples, thus causing the problem of pimples.

DISCLOSURE OF THE INVENTION

The present invention contemplates to eliminate the lowering of the press formability caused by the frictional resistance of the plated surface of the Zn-Ni alloy plated steel plate, and is aimed to improve the press formability without accompanying powdering of the plated layer, such as is encountered in the prior art.

Thus, according to the first aspect of the present invention, there is provided a method for producing a Zn-Ni alloy plated steel plate having superior press formability comprising the steps of plating the surface of a steel plate with a Zn-Ni alloy having the Ni contents of 10 to 17 wt. % and subjecting the plated surface to a dipping treatment using a solution containing one or both of $H_2PO_4^-$ and $HPO_4^{2-}$ ions.

According to the second aspect of the present invention, there is provided a method for producing a Zn-Ni alloy plated steel plate having superior press formability comprising the steps of plating the surface of a steel plate with a Zn-Ni alloy having the Ni contents of 10 to 17 wt. % and subjecting the plated surface to a spraying treatment using a solution containing one or both of $H_2PO_4^-$ and $HPO_4^{2-}$ ions.

According to the third aspect of the present invention, there is provided a method for producing a Zn-Ni alloy plated steel plate having superior press formability comprising the steps of plating the surface of a steel plate with a Zn-Ni alloy having the Ni contents of 10 to 17 wt. % and subjecting the plated surface to an anodic treatment using a solution containing one or both of $H_2PO_4^-$ and $HPO_4^{2-}$ ions.

BEST EMBODIMENT OF PRACTICING THE INVENTION

The process under which the present invention has been arrived at is first explained.

Figure 3:
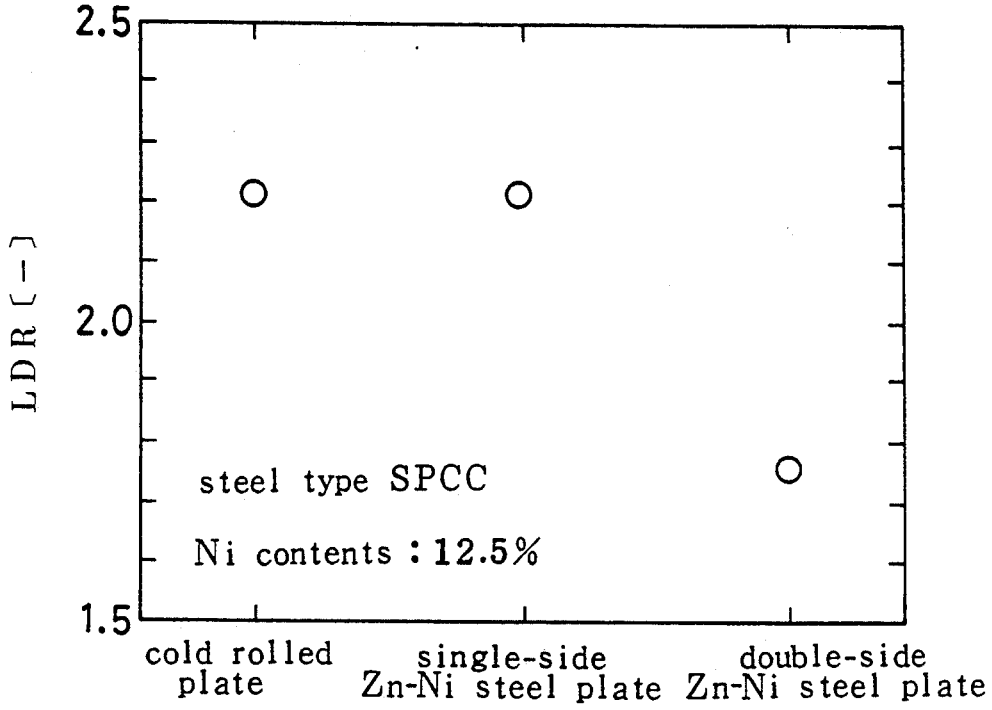
FIG. 3 is a chart showing the result of comparison between the LDR of the Zn-Ni alloy plated plate and that of the cold rolled plate.
Figure 4:
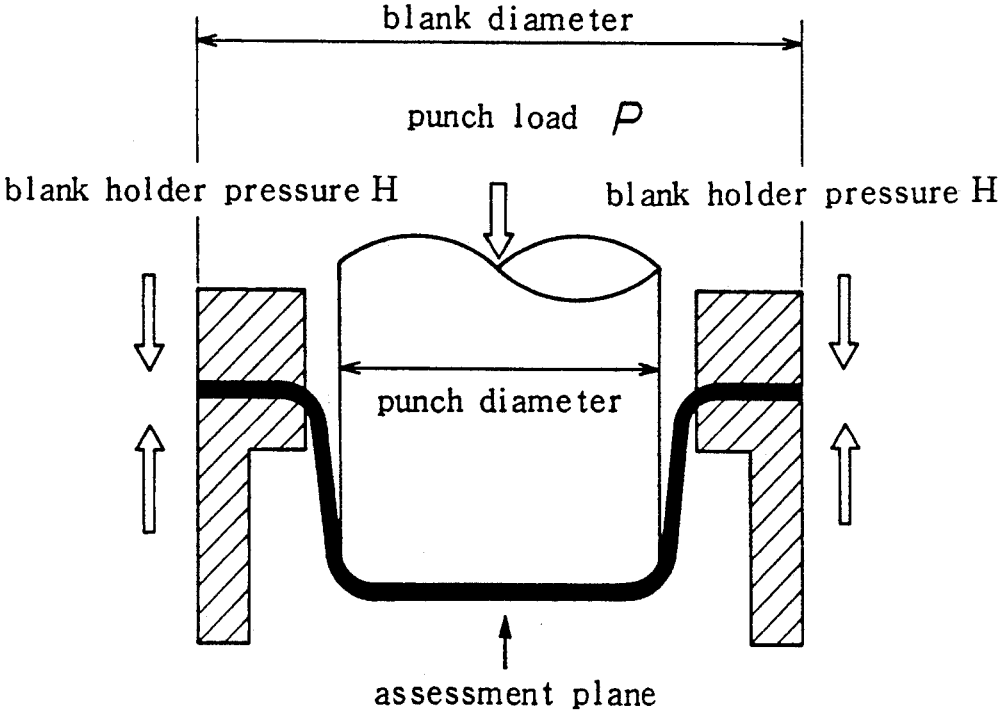
FIG. 4 is a diagrammatic view showing a cylindrical deep drawing tester.

FIG. 3 shows the relative ease with which the cold rolled plate, the single-side Zn-Ni alloy plated steel plate and the double-side Zn-Ni alloy plated steel plate are expressed in terms of the limiting drawing ratio (LDR) in a cylindrical deep drawing testing. The limiting drawing ratio was measured by taking the ratio of the punch diameter to the blank diameter when a test plate is broken as the blank diameter is changed between the values of 60 and 80 mm using a cylindrical deep drawing tester shown in FIG. 4. The testing was performed so that the cold rolled surface of the single-side Zn-Ni alloy plated steel plate turned out to be the protruding surface. The rust preventive oil manufactured by the Idemitsu Kosan Co. Ltd. under the trade name of "Daphney Oil Coat" and a predetermined steel plate type corresponding to SPCC was employed to check only for the effects on the plated layer. The amount of deposition on one side of the plated layer was 30 g/m$^2$, while the Ni contents were 12.5%.

It is seen from this figure that the double-side plated plate is low in LDR and markedly inferior in press formability as compared with the cold rolled plate. Since the plated steel plate is a substitute material for cold rolled plate, it is pressed on a press mold designed for use with cold rolled plates. It was found that the tested plate was broken on a press mold designed for use exclusively with ultra deep drawing steel plate.

Figure 5:
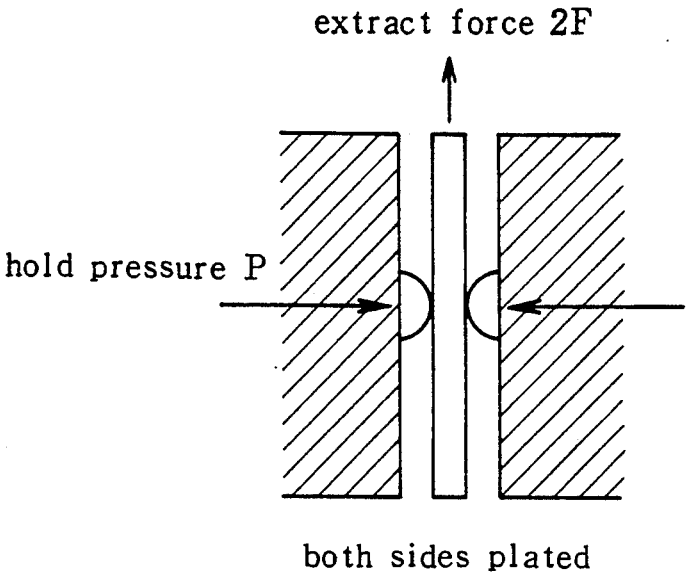
FIG. 5 is a diagrammatic view showing a friction measurement tester.
Figure 6:
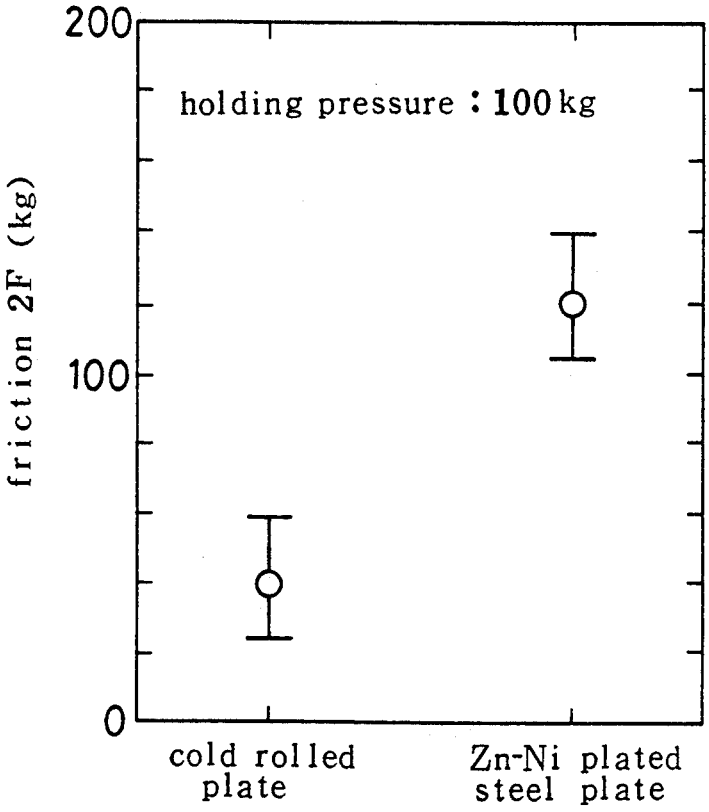
FIG. 6 shows the difference in the friction between the Zn-Ni alloy plated plate and the cold rolled plate.

Since it was felt that the low value of LDR of the plated plate could possibly be attributed to the friction on the surface of the plated plate, the frictional resistance on the surface of the plated plate was tentatively measured by a friction measurement tester. The tester used in this test is shown diagrammatically in FIG. 5. With this tester, the value of the frictional force is assessed from the value of the load required when a sample in the sandwiched state is tracted at a predetermined traction speed. The testing was performed without lubricant. FIG. 6 shows the test results.

It is thought that, as may be seen from this figure, the cold rolled plate differs from the plated plate in surface friction, and this difference possible affects the formability.

Our eager researches were then directed to clarification of the factors governing the friction coefficient of the plated surface of the Zn-Ni alloy plated steel plate. These researches led to the following finding:

i) Changes in the outermost layer of the plated layer result in changes in press formability.

ii) The cold rolled plate is not affected markedly in quality as a result of plating.

Our researches were continued with reference to the above feature i) and it was now found that the press formability could be improved markedly by dipping the Zn-Ni plated surface with the use of a solution containing one or both of $H_2PO_4^-$ ions and $HPO_4^{2-}$ ions.

Figure 1:
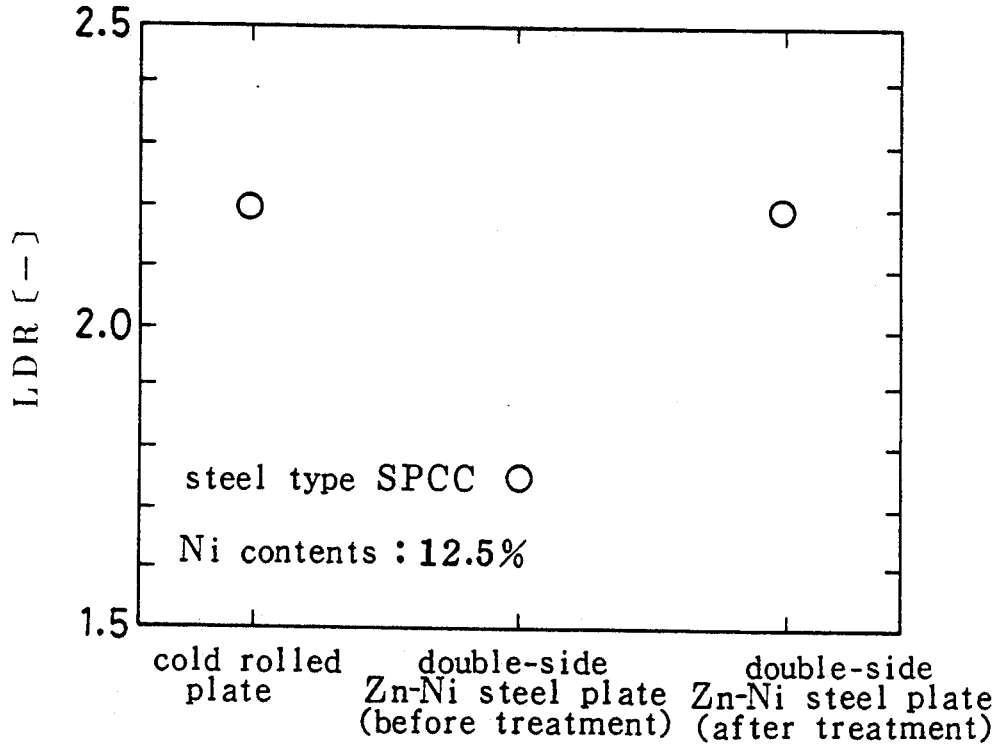
FIG. 1 is a chart showing the limiting drawing ratio (LDR) for illustrating the effect of the present invention following the dipping treatment.

FIG. 1 shows the changes in LDR when the Zn-Ni alloy plated plate was dipped for four seconds in the following solutions. The amount of deposition on one side of the plated plate was 30 g/m$^2$, the Ni contents were 12.5 % and the type of the steel used was SPCC.

| | | |
|---|---|---|
| processing solution | $NaH_2PO_4$ | 200 g/l |
| | $K_2HPO_4$ | 150 g/l |
| | temperature | 60° C. |
| | pH | 5.8 |

It is seen that treatment by this solution of the plated plate results in improved LDR. The results of glow discharge spectroscopy (GDS) revealed that the P peak exists on the surface of the plated plate following the dipping and that this P on the plated plate surface possibly results in improved lubricating properties and improved press formability.

Based on the above theoretical considerations, the practical construction of the present invention will be explained in more detail.

The solution employed in the dipping treatment may contain one or both of $H_2PO_4^-$ ions and $HPO_4^{2-}$ ions Although there is no limitation to the concentration or temperature of the solution, since some time may be involved due to the dipping treatment until the effect is displayed, it is preferred that the temperature and the concentration be elevated for more prompt effects. For short time treatment of less than 10 seconds, suited for industrial production, it is preferred that the dipping temperature be not lower than 40° C. and the concentration in the dipping solution of the $H_2PO_4^-$ and $HPO_4^{2-}$ summed together be not less than 100 g/l.

The Ni contents in the plated plate employed are preferably 10 to 17 wt. % and more preferably 11 to 15 wt. %. The contents lower than 10 wt. % are not effective in the case of the present method, while the contents in excess of 17 wt. % tend to cause powdering in the Zn-Ni plated layer. It is for this reason that the Ni contents of the Zn-Ni alloy plated steel plate of the present invention are limited to the range of 10 to 17 wt. %. In the meantime, addition of Co, Fe, Cr, Cu, Mn, Al etc. in an amount of not more than several percent for further improving the corrosion resistance may be made without departing from the purport of the present invention.

The pH of the solution is preferably 4 to 10. With the pH lower than 4, Zn, above all, of the plated layer is dissolved severely thus decreasing the amount of deposition of the plated material. On the other hand, with the pH above 10, the effect in improving the press formability is annulled. It is for this reason that the pH of the solution is limited to 4 to 10.

The positive ions of $K^+$, $Na^+$, $Mg^{2+}$, $Ca^{2+}$ or $Al^{3+}$ etc. in the employed solution should be electro-chemically less noble than Zn and Ni. It is because metals electro-chemically less noble than Zn and Ni undergo a substitution reaction with Zn or Ni to be precipitated on the plated surface to degrade the appearance when the plated plate is dipped in a solution containing metal ions. The amount of P on the plated surface, when reckoned as P, is preferably 0.1 to 5 mg/m$^2$. With the amount lower than 0.1 mg/m$^2$, the effect is annulled. On the other hand, with the amount in excess of 5 mg/m$^2$, phosphatability is deteriorated.

The treatment by the solution containing $HPO_4^{2-}$ and/or $H_2PO_4^-$ may also be made by spraying by the above solution, in place of the above described dipping. The operating conditions at this time may be approximately the same as those obtained in the dipping treatment.

Also, for improving the press formability of the Zn-Ni alloy plated steel plate, anodic treatment in the above solution may also be performed in place of the dipping and spraying methods. The conditions for anodic treatment include up to 100 c(coulomb)/dm$^2$ since the plated layer, above all Zn tends to be dissolved in excess of 100 c/dm$^2$.

EXAMPLES

In Table 1, the steel plate samples, plating and dipping conditions and the press formability expressed as LDR, are shown collectively. As the lube oil, the "Daphney Oil Coat Z5", a rust preventive oil manufactured by the Idemitsu Kosan Co. Ltd., was used in all cases.

Figure 2:
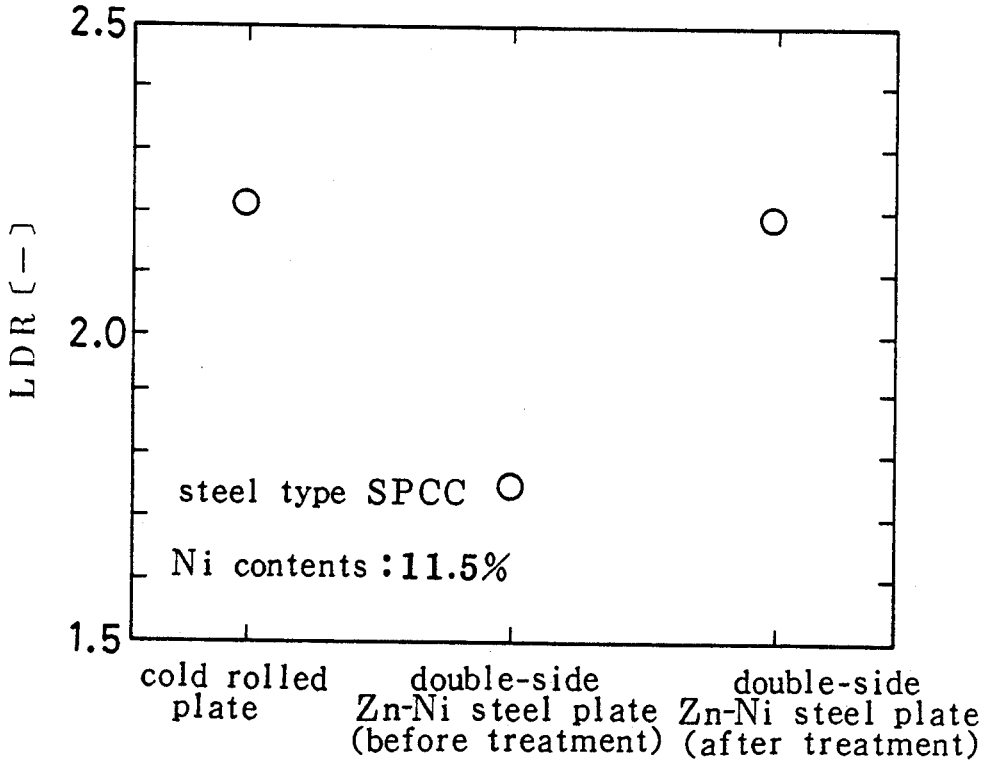
FIG. 2 is a chart showing changes of the limiting drawing ratio (LDR) after the dipping treatment.

For Example 1 and Comparative Examples 1 and 2, the LDR values are shown in FIG. 2 for more clear demonstration of the effects of the present invention.

The examples of spraying and anodic treatment are also shown in Table 2. It may be seen that the Zn-Ni alloy plated steel plate having stable press formability may be obtained by these treatments as by the above described dipping treatment.

TABLE 1

| | | sample plate | | | dipping solution | | | | press |
|---|---|---|---|---|---|---|---|---|---|
| | | steel type | Ni contents (%) | deposition ($g/m^2$) | type/conc. | pH | temperature (°C.) | dipping time | formability LDR |
| Invention | 1 | SPCC | 11.5 | 30 | $NaH_2PO_4$ 350 g/l | 4.3 | 60 | 4s | 2.2 |
| Comparison | 1 | SPCC | 11.5 | 30 | — | — | — | — | 1.75 |
| | 2 | SPCC | — | — | — | — | — | — | 2.2 |
| Invention | 2 | SPCC | 11.5 | 30 | $NaH_2PO_4$ 100 g/l | 4.8 | 35 | 10s | 1.9 |
| | 3 | SPCC | 11.5 | 30 | $NaH_2PO_4$ 100 g/l | 4.8 | 35 | 60s | 2.1 |
| | 4 | SPCC | 12.5 | 30 | $NaH_2PO_4$ 150 g/l | 4.6 | 35 | 10s | 2.0 |
| | 5 | SPCC | 12.5 | 30 | $NaH_2PO_4$ 300 g/l | 4.4 | 60 | 4s | 2.2 |
| | 6 | SPCC | 13.4 | 30 | $NaH_2PO_4$ 250 g/l<br>$Na_2HPO_4$ 100 g/l | 5.8 | 60 | 4s | 2.2 |
| Invention | 7 | SPCC | 10.5 | 30 | $NaH_2PO_4$ 250 g/l<br>$Na_2HPO_4$ 100 g/l | 5.8 | 60 | 4s | 2.2 |
| | 8 | SPCC | 14.8 | 30 | $NaH_2PO_4$ 100 g/l<br>$K_2HPO_4$ 250 g/l | 6.6 | 60 | 4s | 2.2 |
| | 9 | SPCC | 16.5 | 30 | $K_2HPO_4$ 350 g/l | 9.1 | 60 | 4s | 2.2 |
| Comparison | 3 | SPCC | 9.5 | 30 | $NaH_2PO_4$ 250 g/l<br>$Na_2HPO_4$ 100 g/l | 6.6 | 60 | 4s | 1.75 |
| | 4 | SPCC | 9.5 | 30 | — | — | — | — | 1.75 |
| | 5 | SPCC | 12.5 | 30 | — | — | — | — | 1.75 |
| | 6 | SPCC | 13.4 | 30 | — | — | — | — | 1.81 |
| Invention | 10 | SPCC | 12.5 | 20 | $NaH_2PO_4$ 350 g/l | 4.3 | 60 | 4s | 2.2 |
| | 11 | SPCC | 13.5 | 40 | $NaH_2PO_4$ 350 g/l | 4.3 | 60 | 2s | 2.1 |
| | 12 | SPCC | 14.8 | 30 | $NaH_2PO_4$ 350 g/l | 4.3 | 60 | 2s | 2.2 |
| | 13 | SPCE | 12.8 | 30 | $NaH_2PO_4$ 250 g/l<br>$K_2HPO_4$ 100 g/l | 5.8 | 60 | 4s | 2.4 |
| | 14 | SPCE | 11.5 | 30 | $NaH_2PO_4$ 250 g/l<br>$H_3PO_4$ 30 g/l | 4.2 | 60 | 4s | 2.4 |
| Comparison | 7 | SPCE | 11.5 | 30 | — | — | — | — | 1.75 |
| | 8 | SPCE | — | — | — | — | — | — | 2.4 |
| Invention | 15 | SPCE | 12.5 | 30 | $NH_4H_2PO_4$ 100 g/l<br>$K_2HPO_4$ 250 g/l | 6.3 | 60 | 4s | 2.4 |
| | 16 | SPCE | 13.5 | 30 | $Al(H_2PO_4)_3$ 250 g/l | 4.1 | 60 | 8s | 2.4 |
| Comparison | 9 | SPCE | 12.5 | 30 | — | — | — | — | 1.75 |

TABLE 2

| | sample plate | | | treatment | | | | | press |
|---|---|---|---|---|---|---|---|---|---|
| Invention | steel type | Ni contents (%) | deposition ($g/m^2$) | type/conc. | pH | temperature (°C.) | type | conditions | formability LDR |
| 17 | SPCC | 11.5 | 30 | $NaH_2PO_4$ 350 g/l | 4.3 | 60 | spraying | 4s | 2.2 |
| 18 | SPCC | 12.5 | 20 | $NaH_2PO_4$ 350 g/l | 4.3 | 60 | spraying | 4s | 2.2 |
| 19 | SPCC | 13.5 | 40 | $NaH_2PO_4$ 350 g/l | 4.3 | 60 | spraying | 2s | 2.1 |
| 20 | SPCC | 12.5 | 30 | $NaH_2PO_4$ 300 g/l<br>$Na_2HPO_4$ 100 g/l | 4.4 | 60 | anodic | 20 $c/dm^2$ | 2.2 |
| 21 | SPCC | 13.4 | 30 | $NaH_2PO_4$ 250 g/l<br>$Na_2HPO_4$ 100 g/l | 5.8 | 60 | anodic | 20 $c/dm^2$ | 2.2 |
| 22 | SPCC | 10.5 | 30 | $NaH_2PO_4$ 250 g/l<br>$Na_2HPO_4$ 100 g/l | 5.8 | 60 | anodic | 40 $c/dm^2$ | 2.2 |
| 23 | SPCE | 14.8 | 30 | $NaH_2PO_4$ 100 g/l<br>$K_2HPO_4$ 250 g/l | 6.6 | 60 | anodic | 20 $c/dm^2$ | 2.3 |
| 24 | SPCE | 16.5 | 30 | $K_2HPO_4$ 350 g/l | 9.1 | 60 | anodic | 10 $c/dm^2$ | 2.3 |
| 25 | SPCE | 12.5 | 30 | $NaH_2PO_4$ 250 g/l<br>$Na_2HPO_4$ 100 g/l | 5.8 | 60 | anodic | 20 $c/dm^2$ | 2.4 |
| 26 | SPCE | 12.5 | 30 | $NaH_2PO_4$ 350 g/l | 4.3 | 60 | spraying | 4s | 2.4 |
| 27 | SPCE | 12.5 | 30 | $NaH_2PO_4$ 350 g/l | 4.3 | 60 | spraying | 2s | 2.3 |
| 28 | SPCE | 14.8 | 30 | $NaH_2PO_4$ 290 g/l<br>$K_2HPO_4$ 60 g/l | 5.1 | 60 | spraying | 2s | 2.4 |

INDUSTRIAL UTILIZABILITY

According to the present invention, the plated surface of a Zn-Ni alloy plated steel plate is treated by dipping, spraying or by anodic treatment by a solution containing $HPO_4^{2-}$ and/or $H_2PO^{4-}$, whereby i) press formability of the Zn-Ni alloy plated steel plate is improved to the level of the cold rolled plate, and press cracking at the time of press working is eliminated; and ii) press formability is similar for of Ni within the range of the Ni contents of 10 to 17 wt. %, so that fluctuations in press workability caused by fluctuations in the composition of the plating bath or line speed is eliminated;

so that the Zn-Ni alloy plated steel plate having stable formability may be produced with significant industrial advantages.

What is claimed is:

1. A method of producing a Zn-Ni alloy plated steel plate having superior press formability comprising the steps of electroplating the surface of a steel plate with a Zn-Ni alloy having the Ni content of 10 to 17% by weight and subjecting the plated surface to a dipping treatment using a solution at a pH of 4 to 10 containing at least one of $H_2PO_4^-$ and $HPO_4^{2-}$ ions to deposit 0.1 to 5 mg/m$^2$ of phosphate calculated as P.

2. A method of producing a Zn-Ni alloy plated steel plate having superior press formability comprising the steps of electroplating the surface of a steel plate with a Zn-Ni alloy having the Ni content of 10 to 17% by weight and subjecting the plated surface to a spraying treatment using a solution at a pH of 4 to 10 containing at least one of $H_2PO_4^-$ and HPOphd $4^{2-}$ ions to deposit 0.1 to 5 mg/m$^2$ of phosphate calculated as P.

3. A method of producing a Zn-Ni alloy plated steel plate having superior press formability comprising the steps of electroplating the surface of a steel plate with a Zn-Ni alloy having the Ni content of 10 to 17% by weight and subjecting the plated surface to an anodic treatment of up to 100 C/dm$^2$ using a solution at a pH of 4 to 10 containing at least one of $H_2PO_4^-$ and $HPO_4^{2-}$ ions to deposit 0.1 to 5 mg/m$^2$ of phosphate calculated as P.

* * * * *

UNITED STATES PATENT AND TRADEMARK OFFICE

CERTIFICATE OF CORRECTION

PATENT NO. : 5,266,182

DATED : November 30, 1993

INVENTOR(S) : RYOICHI MUKO, et al

It is certified that error appears in the above-identified patent and that said Letters Patent is hereby corrected as shown below:

Column 7, Claim 2, line 9 change "HPOphd $4^2$" to --$HPO_4^2$--

Signed and Sealed this

Twelfth Day of July, 1994

*Attest:*

*Attesting Officer*

BRUCE LEHMAN

*Commissioner of Patents and Trademarks*